US006164825A

United States Patent [19]

Larkin et al.

[11] Patent Number: 6,164,825

[45] **Date of Patent: *Dec. 26, 2000**

[54] STABLE, FLEXIBLE, EASY OPEN POUCH

[75] Inventors: Robert G. Larkin, Richmond, Tex.; Mark W. Holmes, Round Lake Beach, Ill.; James W. Smith, Colleyville; Abigail L. Rodgers, Houston, both of Tex.; Thomas E. Riley, Jr., Chicago, Ill.

[73] Assignee: The Coca-Cola Company, Atlanta, Ga.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/985,116

[22] Filed: Dec. 4, 1997

Related U.S. Application Data

[63] Continuation-in-part of application No. 08/756,528, Nov. 26, 1996, Pat. No. 6,076,968, which is a continuation-in-part of application No. 08/757,822, Nov. 27, 1996, Pat. No. 5,860,743.

[51] Int. Cl.[7] ..... B65D 30/10

[52] U.S. Cl. ..... 383/104; 383/35; 383/44; 383/202

[58] Field of Search ..... 383/104, 202, 383/120, 38, 40, 61, 35, 44, 47, 63, 65

[56] References Cited

U.S. PATENT DOCUMENTS

D. 191,640 10/1961 Stark et al. .
D. 195,313 5/1963 Setecka .

(List continued on next page.)

FOREIGN PATENT DOCUMENTS

454424A1 10/1991 European Pat. Off. .
634341A1 1/1995 European Pat. Off. .
1128387 1/1957 France ..... 383/44
215885 6/1967 Germany ..... 383/94
2622659A 12/1977 Germany .
8900886 3/1989 Germany .
3925871A1 8/1989 Germany .
369809 5/1962 Italy .
639809 5/1962 Italy ..... 383/105
577838 3/1993 Japan .
5330561 12/1993 Japan .
6127552 5/1994 Japan .
6179454 6/1994 Japan .

(List continued on next page.)

*Primary Examiner*—Jes F. Pascua
*Attorney, Agent, or Firm*—Finnegan, Henderson, Farabow, Garrett & Dunner, L.L.P.

[57] ABSTRACT

A flexible pouch includes a flexible compartment with a bottom. A rim is formed around the bottom of the compartment and is spaced from and extends outwardly from this compartment bottom. At least three coplanar feet are provided on the rim for stabilizing the pouch when the pouch is resting on the rim. These coplanar feet can be generally flush with the rim when the pouch is in a flat, empty position. However, when the compartment of the pouch is filled, the coplanar feet will be formed as the lowermost portions of the rim. The pouch will rest on these coplanar feet when on a support to be stably held in position. This pouch design will avoid wobbling or tipping over of the pouch and therefore minimize or eliminate product spillage. Also, a method for making this pouch includes the steps of forming the pouch with the compartment, providing a rim around the bottom of the compartment, and spacing the rim from the bottom of the compartment. A portion of this rim is then removed at the outer edge to form the plurality of coplanar feet. A relatively wide-mouth opening is also provided on the pouch to enable easy insertion of a straw while minimizing or eliminating product spillage. This opening is formed from a frangible element or membrane. Also, the pouch provides for avoiding pressurization of the compartment during opening and provides a way for readily identifying the location of the opening to the pouch.

17 Claims, 3 Drawing Sheets

U.S. PATENT DOCUMENTS

| | | | |
|---|---|---|---|
| D. 206,827 | 1/1967 | Arcudi . | |
| D. 210,818 | 4/1968 | Caliman, Jr. . | |
| D. 236,807 | 9/1975 | Schmit . | |
| D. 282,819 | 3/1986 | Laurent et al. . | |
| D. 285,412 | 9/1986 | Harwell, Jr. . | |
| D. 287,932 | 1/1987 | Seward et al. . | |
| D. 295,835 | 5/1988 | Gautier . | |
| D. 295,946 | 5/1988 | Gautier . | |
| D. 304,546 | 11/1989 | Cattach . | |
| D. 307,385 | 4/1990 | Kimura . | |
| D. 308,164 | 5/1990 | Cazes . | |
| D. 308,482 | 6/1990 | Wild . | |
| D. 309,102 | 7/1990 | Wild . | |
| D. 318,611 | 7/1991 | Sherman . | |
| D. 318,795 | 8/1991 | Christine . | |
| D. 319,176 | 8/1991 | Sherman . | |
| D. 319,780 | 9/1991 | Laaki . | |
| D. 330,511 | 10/1992 | Hauk . | |
| D. 341,157 | 11/1993 | Kitahara et al. . | |
| D. 343,573 | 1/1994 | Shadrach et al. . | |
| D. 350,690 | 9/1994 | Herro . | |
| D. 353,325 | 12/1994 | Chura et al. . | |
| D. 362,618 | 9/1995 | Paling et al. . | |
| D. 364,557 | 11/1995 | Linner . | |
| 2,517,027 | 8/1950 | Rado . | |
| 2,635,788 | 4/1953 | Snyder et al. . | |
| 2,703,127 | 3/1955 | Webb . | |
| 2,760,630 | 8/1956 | Lasko . | |
| 2,849,321 | 8/1958 | Lhermitte et al. . | |
| 2,947,653 | 8/1960 | Fohr . | |
| 2,999,387 | 9/1961 | Andelin . | |
| 2,999,627 | 9/1961 | Reinhardt . | |
| 3,003,681 | 10/1961 | Orsini . | |
| 3,065,898 | 11/1962 | Daugherty . | |
| 3,128,913 | 4/1964 | Specketer . | |
| 3,165,114 | 1/1965 | Garrett . | |
| 3,238,984 | 3/1966 | Shurtleff et al. . | |
| 3,337,117 | 8/1967 | Lehmacher et al. . | |
| 3,367,380 | 2/1968 | Dickey . | |
| 3,380,646 | 4/1968 | Doyen et al. . | |
| 3,418,059 | 12/1968 | Robe . | |
| 3,474,789 | 10/1969 | Soto | 383/109 X |
| 3,502,521 | 3/1970 | Doyen et al. . | |
| 3,545,604 | 12/1970 | Gunther, Jr. . | |
| 3,604,491 | 9/1971 | Spiess . | |
| 3,684,156 | 8/1972 | Fettinger et al. . | |
| 3,730,336 | 5/1973 | Feldman . | |
| 3,799,914 | 3/1974 | Schmit et al. . | |
| 3,810,503 | 5/1974 | Lewis, Jr. et al. . | |
| 3,926,341 | 12/1975 | Lhoest . | |
| 4,010,786 | 3/1977 | Aguettant . | |
| 4,126,167 | 11/1978 | Smith et al. . | |
| 4,126,249 | 11/1978 | Wood . | |
| 4,163,509 | 8/1979 | Amneus . | |
| 4,363,345 | 12/1982 | Scheibner | 383/25 X |
| 4,394,936 | 7/1983 | Shavit . | |
| 4,452,378 | 6/1984 | Christine . | |
| 4,454,979 | 6/1984 | Ikeda et al. . | |
| 4,572,758 | 2/1986 | Wild . | |
| 4,650,452 | 3/1987 | Jensen . | |
| 4,669,124 | 5/1987 | Kimura . | |
| 4,718,778 | 1/1988 | Ichikawa . | |
| 4,732,299 | 3/1988 | Hoyt . | |
| 4,758,099 | 7/1988 | Branson | 383/44 |
| 4,762,514 | 8/1988 | Yoshida . | |
| 4,783,176 | 11/1988 | Ichikawa . | |
| 4,806,021 | 2/1989 | Koudstaal et al. . | |
| 4,818,544 | 4/1989 | Seward . | |
| 4,830,205 | 5/1989 | Hammond et al. . | |
| 4,836,691 | 6/1989 | Suzuki et al. . | |
| 4,887,912 | 12/1989 | Stumpf . | |
| 4,925,316 | 5/1990 | Van Erden et al. | 38/61 |
| 4,974,732 | 12/1990 | Sullivan et al. . | |
| 4,988,016 | 1/1991 | Hawkins et al. . | |
| 4,997,661 | 3/1991 | Kromer et al. . | |
| 4,998,646 | 3/1991 | Sherman . | |
| 5,005,734 | 4/1991 | Van Gordon et al. . | |
| 5,018,646 | 5/1991 | Billman et al. . | |
| 5,080,260 | 1/1992 | During . | |
| 5,094,367 | 3/1992 | Chatourel . | |
| 5,104,235 | 4/1992 | Bronstrup et al. . | |
| 5,121,996 | 6/1992 | Scarrow | 383/44 |
| 5,135,464 | 8/1992 | Buchanan . | |
| 5,140,801 | 8/1992 | Wild . | |
| 5,156,299 | 10/1992 | De Caluwe et al. . | |
| 5,174,458 | 12/1992 | Segati . | |
| 5,188,261 | 2/1993 | Butters . | |
| 5,226,564 | 7/1993 | Steer et al. . | |
| 5,257,865 | 11/1993 | Tani . | |
| 5,273,362 | 12/1993 | Buchanan . | |
| 5,307,955 | 5/1994 | Viegas . | |
| 5,312,189 | 5/1994 | Aeschbach et al. . | |
| 5,316,184 | 5/1994 | During . | |
| 5,348,525 | 9/1994 | Buchanan . | |
| 5,350,240 | 9/1994 | Billman et al. . | |
| 5,352,043 | 10/1994 | Takagaki et al. . | |
| 5,375,930 | 12/1994 | Tani . | |
| 5,378,065 | 1/1995 | Tobolka . | |
| 5,392,589 | 2/1995 | Buchanan . | |
| 5,425,583 | 6/1995 | Wild . | |
| 5,433,526 | 7/1995 | Wild . | |
| 5,468,206 | 11/1995 | Buchanan . | |
| 5,501,757 | 3/1996 | Takagaki . | |

FOREIGN PATENT DOCUMENTS

| | | | |
|---|---|---|---|
| 7291366 | 11/1995 | Japan . | |
| 723588 | 2/1955 | United Kingdom | 383/44 |
| 1109861 | 4/1968 | United Kingdom . | |
| 92 21581 | 12/1992 | WIPO . | |
| 95-23742 | 9/1995 | WIPO . | |
| 95 33663 | 12/1995 | WIPO . | |
| 96 28349 | 9/1996 | WIPO . | |

STABLE, FLEXIBLE, EASY OPEN POUCH

This application is a continuation-in-part of application Ser. No. 08/756,528 filed on Nov. 26, 1996, now U.S. Pat. No. 6,076,968, and of application Ser. No. 08/757,822 filed on Nov. 27, 1996, now U.S. Pat. No. 5,860,743, the entire contents of both applications are hereby incorporated by reference.

BACKGROUND OF THE INVENTION

1. Field of the Invention

The present invention relates to a stable flexible pouch with a flexible compartment and a method for making the pouch. The present invention also relates to an easy open feature of the pouch. This pouch has a rim encircling the bottom of the compartment with portions of the rim being removed in order to form stabilizing coplanar feet. A wide-mouth pocket is provided. A straw can be inserted into this pocket to pierce a frangible membrane for discharge of pouch contents.

2. Description of the Background Art

Various flexible pouches are known in the prior art. These flexible pouches are often unstable when resting on a support. For example, flexible pouches can be made from two sheets sealed together, an extruded tube or other methods. When these pouches are filled, they are often unstable when resting on a support surface. This leads to unnecessary spills resulting in wasted product and a mess.

For example, known flexible pouches are used for as beverage containers. When resting on a table, for example, these pouches have a tendency to wobble and therefore be unstable. These prior art pouches can then easily tip over and the juice or other beverage spilled therefrom. This is especially a problem when children handle the pouches. Accordingly, a need in the art exists for a flexible pouch that can stably rest on a support.

Another problem with known flexible pouches is that they are often difficult to open. In particular, they are very hard to penetrate with a straw. Often when attempting to puncture the packages with the straw, the product will spill. Also, the straw can puncture both the front and back wall of the pouch resulting in an unsatisfactory arrangement. Accordingly, a need in the art exists for a pouch that can be easily opened while minimizing product spillage.

SUMMARY OF THE INVENTION

Accordingly, it is a primary object of the present invention to provide a flexible pouch which can stably rest on a support surface.

Another object of the present invention is to provide a flexible pouch with a flexible compartment for holding contents such as a beverage and which pouch will not rock, tilt or otherwise wobble when filled and resting on a support surface.

Yet another object of the present invention is to provide a flexible pouch which is relatively easy and inexpensive to produce and easy to handle.

Still another object of the present invention is to provide a method for making the stable flexible pouch.

Another object of the present invention to provide a flexible pouch which can be easily opened and in which product spillage is minimized or eliminated.

It is additionally a further object of the present invention to provide a flexible pouch which can be opened with a straw and which would avoid inadvertent piercing of both the front and back of the package.

It is a further object of the present invention to provide a wide mouth pocket on the pouch which can aid straw insertion into the pouch.

Moreover, another object of the present invention is to provide means and a method for readily identifying the characteristics of a pocket of the pouch so that a consumer can easily and quickly open the pouch.

Yet a further object of the present invention is to provide means and a method for avoiding pressurization of the pouch during opening of the pouch to thereby minimize contents squirting from the pouch during opening.

These and other objects of the present invention are fulfilled by a flexible pouch comprising a first sheet having a first edge and a second edge, a second sheet having a first edge and a second edge, the first edges of the first and second sheets being sealed together and the second edges of the first and second sheets being sealed together, a compartment being formed in part by the first and second sheets between the sealed first and second edges thereof, the compartment having a bottom, a frangible element extending between the edges of the first and second sheets, the frangible element defining a portion of the compartment and an opening to the compartment being readily formable in the frangible element, a rim formed around the bottom of the compartment, the rim being spaced from and extending outwardly from the bottom of the compartment, and at least three coplanar feet provided on the rim for stabilizing the pouch when the pouch is resting on the rim.

In addition these and other objects of the present invention are fulfilled by a flexible pouch comprising a membrane, a sealed compartment and means for readily identifying an access pocket, the compartment being formed at least in part by the membrane, the membrane being readily frangible to provide an opening to the compartment, the membrane having at least four edges with first and second edges of the membrane being opposed to one another and third and fourth edges of the membrane being opposed to one another, the first and second edges of the membrane each being in sealed engagement and being on opposed sides of the pocket, the third and fourth edges of the membrane being offset from one another, the means for readily identifying includes the third and fourth edges of the membrane being offset whereby a consumer can readily identify an area of the pouch to open.

Furthermore, these and other objects of the present invention are fulfilled by a flexible pouch comprising a membrane, a sealed compartment and means for avoiding pressurizing of the pouch during opening of the pouch, the compartment being formed at least in part by the membrane, the membrane having two walls, the two walls of the membrane meeting at a crease therebetween and each wall having a top edge, the two walls of the membrane forming a V-shape and the walls of the membrane being movable toward and away from one another to define a pocket recessed within the membrane, the membrane being readily frangible at least at the crease to provide an opening to the compartment, and the top edges of the walls of the membrane being offset from one another, the means for avoiding pressurizing including an area on one of the top edges of the wall which is grippable by a consumer such that an increase in pressure of the sealed compartment can be avoided.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
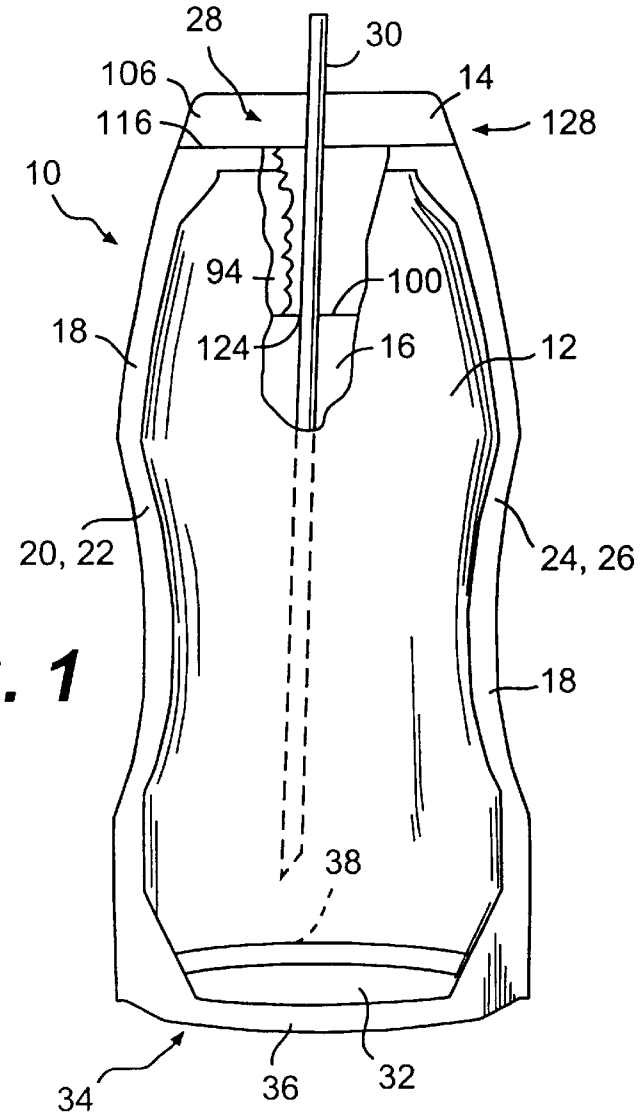
FIG. 1 is a front elevational view of the flexible pouch of the present invention with certain portions broken away.

Referring in detail to the drawings and with particular reference to FIG. 1, a flexible pouch 10 is shown. This flexible pouch can be made from a heat-sealable, heat-weldable or ultrasonic sealing flexible laminate such as a aluminum sheet covered with a plastic material or from any other suitable material. The pouch 10 can be filled with liquid such as beverages, liquid, pasty media, fine granular material or any other suitable objects. It is contemplated that the flexible pouch will primarily be used as a beverage container.

Figure 2:
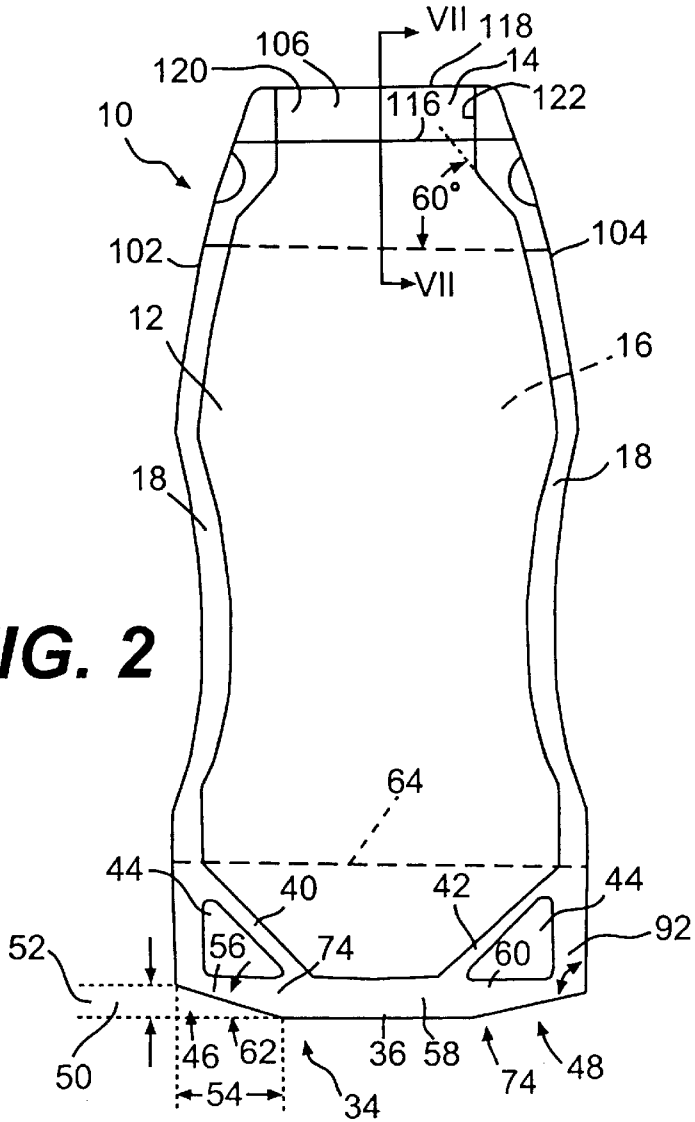
FIG. 2 is a view similar to FIG. 1 of an empty pouch.

As seen in FIGS. 1 and 2, this flexible pouch 10 generally has an hour glass or figure eight shape. The flexible pouch is made from a first sheet 12 and a second sheet 14. In FIG. 1, the first sheet 12 is in front of the second sheet 14. The shape of the first sheet 12 matches the second sheet 14 except at the uppermost edge thereof as will be explained in more detail below. In particular, the second sheet 14 is slightly longer than the first sheet 12 such that the upped edge of the second sheet 14 extends above the upper edge of the first sheet 12. The two sheets 12 and 14 are sealed together around their periphery to form a compartment 16. The compartment 16 formed between the first and second sheets 12, 14 will hold the contents of the flexible pouch 10. For example, a beverage can be placed within this compartment 16. It is contemplated that this compartment will initially be hermetically sealed.

A seam 18 extends along the sides of the first and second sheets 12 and 14. While the seam is shown as being continuous from the top of sheet 12 adjacent the top of the pouch to the bottom of sheet 12 adjacent an underlying rim 34 in the figures, it should be appreciated that the seam 18 could be discontinuous as long as the compartment 12 was sealable. This seam 18 can be formed by heat-sealing, heat-welding or ultrasonic sealing the two sheets 12 and 14 together. Otherwise, adhesives, crimping or any other suitable arrangement can be used in order to bond these sheets together. Also, a single extruded tube can be used in place of the two sheets 12, 14. Alternatively, a single sheet can be folded over on itself and can have its free ends bonded together to thereby define a portion of the sealed compartment 12. It is merely necessary that an appropriate sealed compartment 12 be provided. It is contemplated that this compartment 16 will be fluid-tightly sealed as noted above.

A first edge 20 of the first sheet 12 and a first edge 22 of the second sheet 14 are provided on the left-hand side of the pouch 10 as seen in FIG. 1. The seam 18 extends along these first edges 20, 22. In addition, a second edge 24 on the first sheet 12 and a second edge 26 on the second sheet 14 are provided along the right-hand side of the flexible pouch 10. The edges 22, 26 of the second sheet 14 are behind the first edges 20, 24 respectively, of the first sheet 12. The edges 20, 22 and the edges 24, 26 conform such that the shape of the first and second sheets 12, 14 along the sides of the pouch 10 are uniform. Of course, one sheet could be slightly larger than the other sheet on either or both sides of the compartment. As previously noted, the first edges 20, 22 are sealed together and the second edges 24, 26 are sealed together.

Figure 6:
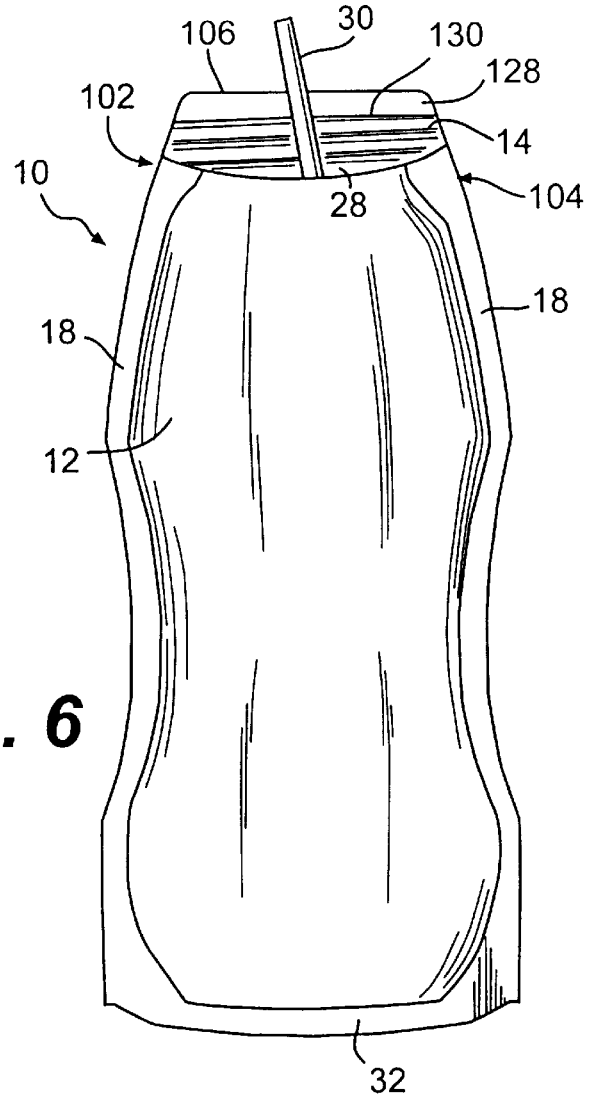
FIG. 6 is a view similar to FIG. 1 without the broken away portions.

In the pouch shown in FIGS. 1 and 6, a pocket 28 is provided at the top of the pouch 10 for receiving straw 30. This straw 30 can pierce the material of the pocket in order to be inserted into the compartment 16. The contents of the pouch 10 can then be discharged. In other words, a consumer can drink the beverage contained within the pouch 10 through straw 30.

The pocket 28 is formed from a frangible element or membrane 94 which extends between the two side seams 18. The frangible element or membrane 94 forming pocket 28 is between the first and second sheets 12, 14. This element or membrane 94 is partially shown in FIG. 1 because a portion of the first sheet 12 has been removed.

Figure 7:
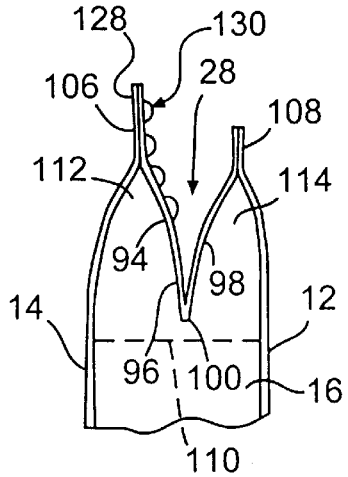
FIG. 7 is a cross sectional view taken along line VII—VII of FIG. 2.

FIG. 7 is a side view between the first and second sheets 12, 14 taken along line VII—VII of FIG. 2. As can be seen in FIG. 7, the frangible element or membrane 94 includes a flexible first gusset provided at the end of the pouch. When the pouch 10 is standing upright, this end will be the top of the pouch. This gusset generally has a V-shape. Two walls 96, 98 are provided on the one-piece gusset. These walls 96, 98 converge to form the V-shape in side sectional view.

In particular, it is contemplated that the flexible first gusset forming the frangible element or membrane 94 is a single sheet which has been folded to form a crease 100. This crease 100 is generally linear and extends to the outermost edges 102, 104 of the first and second sheets 12, 14 as indicated in FIG. 6. This crease length is achieved because the first gusset has the same length and shape as the sheets 12, 14 at the top of the flexible pouch 10. Of course, any other suitable configuration could be had for the gusset. In other words, the frangible element or membrane could be formed from a flexible gusset which does not extend completely to the outermost edges 102, 104 of the sheets or which extends beyond these edges. While it is contemplate that the contour of the outer edges of the frangible element or membrane 94 will match the contour of the uppermost portion of the pouch 10, other designs for the frangible element or membrane 94 are possible. Also, instead of using a single gusset which is folded to form crease 100, two separate membranes could be welded or otherwise adhered to one another to form a crease along the joint between them.

Two seams 106, 108 are provided at the upper end of the pouch 10. The wall 96 of the frangible element or membrane 94 is heat-sealed or heat welded or otherwise sealed to the second sheet 14 at seam 106. This frangible element or membrane 94 is also adhered at its wall 98 to the first sheet 12 along seam 108. It should be noted that seam 106 is longer than seam 108. Therefore, the frangible element or membrane 94 is not completely symmetrical about the crease 100. Moreover, the rear or second sheet 14 is slightly longer than the first sheet 12. As seen in FIG. 2, this seam 106 provides an exposed area which a user can grip in order to hold the pouch. Such an arrangement can be useful when attempting to insert a straw 30 into the wide mouth pouch 10 as will be described below.

Of course, the instant invention will work regardless of where it is held by the user. In other words, it is not necessary for the user to grasp this seam 106 in order to insert the straw 30 into the pouch 10. It is therefore possible for the lengths of the first sheet 12 and second sheet 14 to be the same. In such a modified arrangement, the uppermost edges of seams 106 and 108 would be aligned. In such a modified arrangement or in the arrangement shown in the drawings, it should be noted that the top of the pouch between the edges of the second sheet 14 is generally flat. It is contemplated that when the pouch 10 is filled and standing upright, the upper edge of the pouch will be horizontal. As will be described below in more detail below, the gusset of the frangible element or membrane 44 will define a pocket 28. At least when the pocket is closed, the upper edge 116 of the first sheet 12 will also be flat and generally horizontal when the pouch is standing upright.

The frangible element or membrane 94 is made from a readily rupturable material such as a flexible laminate. A straw 30 can be inserted into the area formed between the walls 96, 98 of the frangible element or membrane 94. Then a small portion of the crease 100 will be pierced by the straw to form an opening 124 to the compartment 16. It should be noted that the diameter of the straw 30 is relatively small compared to the length of the crease 100. In other words, the length of the frangible element or membrane 94 is considerably greater than that of the diameter of the straw 30. Only a small drink opening 124 is punctured in the pouch 10. It is not contemplated that the entire seam or crease 100 will be ruptured. In other words, the drink opening 124 extends over a portion of the gusset but is out of contact with the first and second sides of the pouch 10 at seams 18. However, the entire length of the crease 100 could be ruptured if so desired.

Within the areas between the first and second sheets 12, 14 at the top of the pouch, the above-noted pocket 28 is formed. This pocket 28 has a wide mouth or opening which can easily accommodate insertion of the straw 30. A portion of the first and second sheets 12, 14 are movable toward and away from one another to define this pocket 28. The first and second edges 116, 118 of the sheets 12, 14 are sealed at 106 and 108 to the frangible element or membrane 94. Also, the edges of the sheets 12, 14 are sealed with the gusset 94 therebetween at edges of the pocket 28 to thereby form the pocket.

The gusset of this frangible element or membrane 94 will be exposed when the first and second sheets 12, 14 are moved away from one another. It is not contemplated that the seams 18 at the sides of the sheets 12, 14 and gusset 94 will be ruptured. Rather, the sheets and gusset will be bowed in order to open the mouth opening of the pocket 28. Of course, the seams 18 at the top of the pouch could be torn if the sheets 12, 14 were pulled sufficiently far apart. Because the frangible element or membrane 94 extends completely across the pouch to the outermost edges of the sheets 12, 14, such an opening of the sides of pocket 28 should not detrimentally effect the sealing of the pouch.

In other words, as seen in FIG. 6, the crease 100 of the frangible element or membrane 94 will extend completely between the outermost edges 102, 104 of the membrane. Therefore, closed sides of pocket 28 are formed by the edges of sheets 12, 14 and the edges of the membrane 94 all being welded or otherwise sealed along seam 18. As noted this seal between the side edges of the seams 106, 108 could be omitted. It is preferable, however, to extend these side seams 18 to the tops of the sheets 12 and 14 such that the pocket 28 is clearly defined.

Nonetheless, as noted above, it is contemplated that either and or both of the sheets 12, 14 will be bowed at their top portion in order to open the pocket 28 and insert the straw 30. Moreover, it should be noted that it is not necessary for the consumer to expressly open this pocket 28. Rather, insertion of the straw 30 will act to slightly wedge these sheets 12, 14 as well as the walls 96, 98 of the frangible element or membrane 94 apart in order to open the pocket. Accordingly, only a very slight opening of the pocket 28 can be carried out. On the other hand, the pocket 28 is sufficiently big such that a user could insert his or her fingers in order to more fully open the pocket before or during insertion of the straw 30 if needed.

As seen in FIG. 7, a majority of the frangible element or membrane 94 is contained between the first and second sheets 12, 14. A small portion of the rear wall 96 of the membrane 94 would extend above the top of the upper seam 108 of the first sheet 12. This extended portion at seam 106 acts as the means 128 for avoiding pressurizing of the pouch during opening of the pouch 10 as noted above.

This exposed area of seam 106 can also act as means 130 for readily identifying the access pocket 28. The membrane 94 can be made from a different material and/or have a different external color from at least the first sheet 12. Of course, a contrast between the membrane 94 and the exposed portions of the second sheet 14 could also be provided if so desired. Because there is this portion of the membrane which extends above the top edge of the first sheet 12, the membrane is exposed and readily visible to a consumer. This exposed portion of the membrane can therefore act as the means 30, alternatively referred to as a characteristic feature or signal, for readily identifying the access pocket 28 as noted above.

The pocket 28 extends across the top of the pouch to the side seams 18 and therefore with this signal, a consumer can easily be given an indication of where to insert the straw 30 or other opening device. In fact, written or visual indicia can be printed on the face of the first sheet 12 to further instruct a consumer about the location of the pocket. Due to the contrast between the first sheet 12 and the exposed portion of the membrane 94, a visual clue is provided to the consumer as to where to open the pouch 10 which does not require the consumer to read any particular opening instructions. The entire membrane 94 can be of a different material or color than the first and/or second sheets 12, 14 or only the exposed portion of the membrane can have this contrast as desired. Alternatively, the exposed portion of the membrane could be coated with a foil contrasting with the face of the first sheet. Another alternative is to have the membrane 94 have raised ridges or bumps thereon to further contrast with the flat sheet 12 to therefore draw attention to the pocket 28 and provide a signal to the consumer. Other combinations to provide contrast are possible. It is contemplated that the membrane will be made from a metallic non-printed foil and the first sheet 12 from a printed foil to provide this contrast.

If the means 130 for readily identifying the access pocket were to be omitted, the uppermost edge of this wall 96 could terminate at or below the uppermost edge of the first sheet 12 if so desired. In other words, it is now contemplated that the uppermost edges of the walls 96, 98 will extend to the uppermost edges of the seams 106, 108 to match the uppermost edges of the walls 12, 14. However, these uppermost edges of the walls 96, 98 of the membrane 94 could be terminated short of the uppermost edges of the walls 12, 14, if so desired.

When the frangible element or membrane 94 is unfolded, it will have a length which is shorter than that of the first and second sheets. For example, the rear wall could have a length of 1.19 inches whereas the overall length of the second wall 14 would be 6.50 inches. Likewise the length of the forward wall 98 could be 0.79 inches whereas the length of the first sheet 12 could be 6.1 inches. Therefore, there would be a total length of 1.98 inches for the frangible element or membrane 94 and this total length is considerable less than the 6.50 inch or 6.1 inch length of the second and first sheet 14, 12, respectively. These particular lengths are merely given as an example and it should be appreciated that the present pouch can be of any suitable size.

As previously noted, it is contemplated that the frangible element or membrane 94 will be a unitary one piece structure. Before the pocket 28 is opened or even when this pocket 28 is only slightly opened to accommodate a straw, the upper edges 116, 118 of the sheets 12, 14 will be generally parallel to the crease 100 formed by the folded frangible element or membrane 94.

A wide mouth area is formed by pocket 28 for easy insertion of the straw 30 as noted above. As seen in FIG. 2, the innermost edges 120, 122 of the seams 18 terminate at the sides of the pocket 28. In other words, the edges of the first sheet 12, second sheet 14 and the frangible element or membrane 94 are all sealed such that the sides of the pocket are closed. The distance between the edges 120, 122 at the upper side of the pouch 10 can be 1.88 inches, for example. Therefore, a relatively wide area is provided. This enables easy insertion of the straw. It is contemplated that the crease 100 will be pierced anywhere along its length between these edges 120, 122. It is not contemplated that the entire crease 100 would be ruptured although this is possible if so desired.

The sloping walls 96, 98 of the frangible element or membrane 94 will act to cam or guide an end of the straw 30 towards the crease 100 as can be appreciated from FIG. 7. The opposed walls 96, 98 of the gusset forming the frangible element or membrane 94 act as a guide for the straw. As seen in FIG. 1, the end of the straw 30 is tapered. This tapering can also aid in puncturing of the crease 100. However, a flat end similar to the upper end of the straw 30 could be used. Moreover, while a generally straight straw 30 is shown, it is contemplated that a flexible straw or any other known straw could be utilized with the pouch 10 of the present invention.

When using the present invention, the straw 30 will be inserted from the outside of the compartment 16. This straw 30 can be somehow bonded or otherwise attached to the exterior of the pouch 10 if so desired. Such a bonding should be easily rupturable so that the straw can be removed from the pouch 10 and inserted into the pocket 28 in order to pierce the frangible element or membrane 94. While it has been discussed that the straw will pierce a portion of the crease 100, any suitable portion of the frangible element or membrane 94 could be punctured. For example, it would be possible to form the frangible element or membrane 94 such that the crease would slope downwardly in a V-shape. Then, this arrangement would guide the straw to the central part of the pocket 28. Additionally, the frangible element or membrane 94 could be formed without a crease 100 such that any area of this membrane would be pierced by the straw 30. For example, a flat membrane could extend between the first and second sheets 12, 14. Any suitable portion of this membrane can be pierced.

However, due to the provision of the relatively large pocket 28, the straw is easily inserted into the pouch 10. It is unlikely that a user will pierce the front and back of the pouch 10 in the instant invention. Rather, it is likely that the frangible element or membrane 94 alone will be ruptured such that a suitable seal will be maintained for the pouch 10 except at this rupture area. This rupture or opening 124 will enable the contents of the pouch to be withdrawn. In other words, the beverage can be drunk from the pouch through straw 30. This limited opening arrangement will minimize or eliminate product spillage from the pouch 10. The pocket 28 will act as a reservoir which will contain any liquid which is expelled from the pouch from opening 124.

As seen in FIG. 7, the contents such as a beverage can be filled to level 110 within the compartment 16. If the pouch 10 is compressed, the level of the liquid will rise above the crease 100. Alternatively, this content level 110 could always be above the crease 100 when the pouch 10 is initially filled. Either way, due to the provision of spaces 112, 114 within the compartment 16, a level of contents 110 can be above opening 124, if so desired.

It is contemplated that the seam 106 will be of a sufficient length and width to allow a consumer to readily grasp the pouch 10. This seam 106 is formed by the rear wall of the membrane 94 and the second sheet 14 and is a flat area. This flat area extends completely across the top of pouch 10 with a constant width. This width of the seam 106, however, could be varied across the top of the pouch 10 if so desired. For example, rather than having a wide seam which is grippable by a consumer at any location along its length, this seam 106 could have two or more sections with one section having a width sufficient to receive a consumer's opposed finger and thumb while the remainder of the sections would have a reduced width. It is nonetheless contemplated that a complete seam 106 will extend across the top of the pouch 10. Therefore, the compartment 16 will be hermetically seal until opening 124 is formed.

Because no air pocket or liquid filled area is provided at the seam, the gripping of seam 106 will not result in increased pressure within the compartment 16 prior to opening of the compartment 16. This seam 106 therefore provides means 128 to avoid pressurizing the compartment prior to opening the compartment 16. In other words, if a consumer were to grip the middle portion of the pouch 10, then pressure would increase in the interior of compartment 16. When the straw 30 is inserted into the wide mouth pouch 10, juice or other contents within the pouch 10 could squirt out. Therefore the seam 106 acts as the means 128 for avoiding pressurizing of the pouch during opening thereof. Spills and the resultant loss of product associated with the contents squirting from the pouch 10 during opening therefore can be avoided.

Apart from the flexible pouch 10, a method for dispensing contents from a flexible pouch is disclosed by the present invention. In this method, the step of providing a compartment 16 within a flexible pouch 10 is provided. This compartment is initially sealed. Additionally, two sheets 12, 14 and a gusset of a frangible element or membrane 94 is provided. The two sheets 12, 14 and gusset 94 will form a portion of the compartment 16. The two sheets 12, 14 will have sealed edges 18 and the gusset of the frangible element or membrane 94 will be at a first end of the compartment 16. The method additionally includes the step of separating a portion of the first sheet 12 from a portion of the second sheet 14 adjacent the first end of the compartment 16 in order to expose the gusset 94. The compartment is maintained in a sealed state during the step of separating. The gusset of the frangible element or membrane 94 is then pierced by a straw 30. As previously noted, this step of inserting the straw 30 can actually cause the separation of the portions of the first and second sheets 12, 14. Then, the contents within the compartment 14 are removed through the opening 124 in the gusset.

Instead of using a straw 30, a suitable tool such as pin, funnel or nail, for example, could be used to pierce the frangible element or membrane 94. This tool would then be removed and the contents of the pouch 10 can be poured through the opening. However, it is contemplated that the pouch 10 will be normally be used as a beverage container and therefore a straw 30 will normally be used to discharge the contents.

When the opening 124 is formed, it is contemplated that this will be the only opening to the compartment 16. Of course, a plurality of openings could be provided in the frangible element.

Due to the means 128 for avoiding pressurizing of the pouch, at least one method for avoiding spilling of pouch contents is provided. This method involves the steps of providing a flexible pouch 10 with a membrane 28, a sealed compartment 16 and a flat upper seam 106. The compartment 16 is formed at least in part by the membrane 94 which has two walls 96, 98. The two walls of the membrane 94 meet at the crease 100 therebetween and each wall has a top edge 116, 118. The two walls of the membrane 94 form a V-shape and the walls of the membrane are movable toward and away from one another to define the pocket 28 recessed within the membrane 94. The method further includes the step of forming the opening 124 in the crease 100 of the membrane 94 which is a readily frangible material. The top edges 116, 118 of the walls of the membrane 94 being offset from one another. An area at 130 on one of the top edges of the walls is gripped by a consumer without causing an increase in pressure of the sealed compartment 16.

A stabilization feature is also provided with the present invention. Encircling the bottom 32 of the compartment 16 is rim 34. This rim comprises a first rim section 38 and a second rim section 36. This first rim section 36 is actually the outwardly extending seam between the first sheet 12 and the material of the bottom 32 of the compartment. The second rim section 38 is the outwardly extending seam between the second sheet 14 and the material of the bottom 32 of compartment 16. These rim sections 36, 38 together form the complete rim 34. Ends of the rim sections 36, 38 are engaged and bonded together. When forming the pouch such as by heat-sealing, heat-welding or ultrasonic bonding, the seams 18 and seam of the rim 34 are formed. The seams extend completely along the height of the rim 34. In other words, the bottom 32 of the compartment 16 has a corner adjacent the termination of this lower seam and therefore adjacent the rim 34. The rim 34 extends completely around the bottom 32 of the compartment thereby encircling this bottom 32. The height of the rim will vary as will be discussed below. The seam forming the rim extends into the two side seams 18.

As seen in FIG. 1, the left-hand seam 18 is partially bent forwardly while the right-hand seam 18 is bent rearwardly (or into the page). While this particular design is shown in FIG. 1, it should be appreciated that the seams 18 could extend in a reverse direction or both seams could extend either forwardly or rearwardly or could be straight out. In this FIG. 1, the compartment 16 of the pouch 10 is filled. Therefore, pouch 10 will bulge outwardly. When the compartment is empty, it is contemplated that the pouch will be flat as seen in FIG. 2.

In particular, FIG. 2 shows the flat pouch 10 in elevational view with certain seam features emphasized. In FIG. 2, the second rim section 38 is behind the first rim section 36. These two rim sections are abutting one another when the container is flat. As can be seen in FIG. 2, the seam along this first rim section 36 runs into each of the side seams 18. In addition, a cross seam 40 is formed at the lower left-hand portion of the compartment 16 while another cross seam 42 is formed at the right-hand lower side of compartment 16. The bottom 32 of the compartment is engaged with the sheets 12 and 14 along these cross seams 40, 42 and is out of engagement with the rim 34 which extends onto the side seams 18.

These seams 40, 42 are not readily visible when viewing the exterior of the container. A thin line or patterned section may merely be visible on the exterior of the pouch indicating where the seams are heat-sealed, heat-welded, ultrasonically sealed or otherwise formed or no visible indication may be provided on the exterior of pouch 10. Formation of these seams provides heat sinks 44. These heat sinks 44 are merely areas which are omitted or cut out from the seal dies when forming pouch 10. Any suitably sized or shaped or number of heat sinks 44 can be used or they can be omitted altogether.

As seen in FIG. 2, the outer edges of the first rim section 36 are beveled as indicated at 46 and 48. Similar to the first rim section 36, second rim section 38 also has matching beveled ends 46, 48. In FIG. 2, a support surface 50 on which the pouch 10 rests is shown. The support surface can be a table, or any other suitable surface. The pouch 10 is placed on the support 50 in an upright position as indicated in FIG. 10. In other words, the longitudinal axis of the pouch 10 will be vertically positioned and will be generally perpendicular to the top of support surface 12.

As seen on the left-hand side of FIG. 2, the beveled outer ends 46, 48 of the first rim section 36 will be spaced from the support 50 by a distance 52. This distance can be an eighth of an inch (0.13 inch), for example. The right-hand beveled outer edge 48 is also similarly spaced from the support 50. This support 50, however, has not been shown on the right-hand side in order to more clearly show the beveled end 48. The distance 54 or length of the beveled end 46 can be ¾ inch (0.75 inches), for example. It is contemplated that the right-hand beveled outer end 48 will also have similar dimensions to the left-hand outer end 46. In other words, the bottom of the pouch 10 will be symmetrical.

Of course, this bottom can be asymmetrical, if so desired. For example, the length 54 of the bevel or the depth 52 of the bevel could be different from side to side of the pouch, if so desired. Also, any suitable length 54 or depth 52 can be used. These particular dimensions will depend upon the bottom design of the pouch 10. For example, a wider pouch with a larger compartment 16 would have a different sized cut for the bevel of end 46, 48 than a smaller or narrower sized pouch.

Due to the provision of these outer beveled ends 46, 48, the first rim section 36 is actually divided into a first beveled end portion 56, a middle portion 58, and a second beveled end portion 60. The middle portion 58 is between the first and second beveled end portion 56, 60. While FIG. 2 shows the first rim section 36 as having these portions 56, 58, and 60, it should be appreciated that the second rim section 38 also has such portions 56, 58, and 60. It is contemplated that the portions sections 36, 38 will be sized the same such that the rim 34 is symmetrical from front to back. Of course, the length or depth of the bevel can vary between the first rim section 36 and second rim section 38, if so desired. Nonetheless, for greater stability, these bevels should match between the first rim section 36 and second rim section 38.

When forming the pouch 10, a blank can be made for the pouch. This blank will have the bottom corners cut away in order to form the beveled end portions 56, 60. It is possible that this step of cutting away the corners of the pouch can be done before the first and second sheets 12, 14 are bonded together or after this step is carried out. Of course if the pouch 10 is formed from an extruded tube, for example, there would be no step of bonding sheets together.

Due to the provision of the beveled end portions 56, 60, an angle 62 will be formed between the beveled end portions and the support 52 as indicated in FIG. 2. When the first and second beveled end portions 56, 60 are symmetrical, this angle 62 will be the same on both the left and right sides of the pouch 10. If a ¾ inch by ⅛ inch wedge cut is made at the bottom of the pouch, the angle 62 can be found from the following formula:

$$\Theta = \text{ARCTAN } 0.13/0.75 = 9.83°.$$

While an example of an angle of 9.83° has been given, it should be noted that this angle can be between 4 and 25°. More specifically, the angle can generally be between 8° and 15°. If too much of the bottom rim 34 is cut away, then the lower seal for compartment 16 could be affected or the area of heat sink 44 could be interfered with. However, if too little material is cut away, it can be difficult to remove the cut-away portion or scrap from the die. Therefore, a certain size angle is necessary. However, this angle can vary depending upon the size of the cut for the beveled outer ends 46, 48 which is dependent upon the size of the pouch 10.

Apart from this angle 62, another angle 92 is formed between the bottom edge of the pouch at the outer ends 46, 48 and the side seam of the pouch 18 at each of the bottom corners. This angle 92 at each corner is an angle of more than 90°. In other words, an angle 92 of greater than 90° is formed between the bottom of the rim 34 and a side of the pouch 10 at a junction of the rim with at least one of the side edges.

While the cut for the outer ends 46, 48 has been shown and described as a straight cut, it should be appreciated that an inwardly or outwardly curved cut could be used. Also, a sawtooth cut, a wavy cut or any other type of cut is possible. It is merely necessary that the outermost-edges of the seams 18 are out of contact with the support surface 50 when the pouch is resting thereon.

In FIG. 2, the pouch 10 is shown in a flat position. The bottom 64 is folded in half along crease line 64 schematically indicated in FIG. 2. The sheet or membrane which makes the bottom 32 of compartment 16 is affixed to a part of the middle portion 58 of the first and second sections 36, 38 of the rim. Then the membrane of the bottom 32 of the compartment 16 is sealed along the inclined cross seams 40, 42 on both the first and second sheets 12 and 14. When the compartment 16 is filled, downward pressure will be exerted on the bottom 32 of the compartment. The folded area indicated at 64 will move downwardly in order to form a bowl shape for the bottom membrane. Put another way, when viewing this bottom membrane from the exterior of the pouch 10, the membrane will have a convex U-shape. In FIG. 1, the membrane of the bottom 32 has merely been shown as generally being flat in order to simplify illustration of the pouch.

Figure 5:
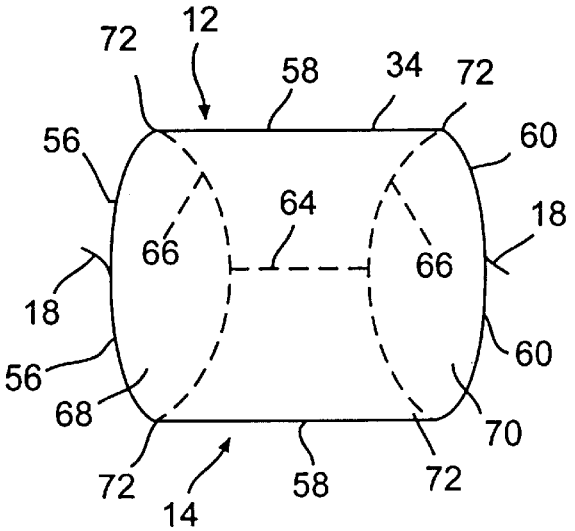
FIG. 5 is a bottom view of the pouch of the present invention.

However, FIG. 5 shows the bottom of pouch 10. Lines 66 indicate how the edge of the flat bottom portion (which is the lowermost portion) of the membrane of the bottom 32 is positioned relative to rim 34. While the crease formed by fold 64 is partially shown in FIG. 5, it should be appreciated that this crease may actually disappear or at least be generally flush with the bottom 32 of the compartment 16 when the pouch 10 is filled.

Because the membrane of the bottom 32 of compartment 16 is sealed along the cross seams 40 of both the first and second sheets 12, 14, there is a slight space or recess 68, 70 formed at the sides of bottom 32 of the pouch 10. It should be appreciated that because the material of the membrane of the bottom 32 of compartment 16 is a flexible material, the exact shape of the bottom membrane can vary. For example, if the pouch was squeezed on one side, the lines 66 indicating the periphery of the flat section of the bottom could shift. FIG. 5 should nonetheless indicate that a majority of the bottom membrane is generally flat and exposed when pouch 10 is filled. This membrane of the bottom 32 of compartment 16 is spaced from the support as schematically indicated in FIG. 1. In other words, the rim 34 positions the bottom 32 of the compartment 16 away from support surface 50 when the compartment 16 is filled.

As seen in FIG. 5, both the first sheet 12 and second sheet 14 have the rims 34 divided into the first beveled end portion 56, middle portion 58, and second beveled end portion 60. This arrangement has been discussed above. The first and second beveled end portions 56, 60 generally terminate before the area of the corners 72. While areas 72 have been referred to as corners, it should be appreciated that these corners will actually be movable due to the flexible nature of the pouch and membrane of the bottom 32 of compartment 16. For example, if the one side of the pouch in FIG. 5 were compressed, then the corners 72 could move to a different position. Nonetheless, in the normal filled position, the corners 72 will be spaced from the innermost ends 74 of the beveled end portions 56, 60. Moreover, it should be appreciated that these corners 72 are not actually square corners but rounded areas forming a transition between the sides and front of the pouch and between the sides and back of the pouch 10.

It is contemplated that the first sheet 12 and second sheet 14 as well as the membrane of the bottom 32 of compartment 16 will be made from the same material. For example, a flexible laminate such as an aluminum sheet cover with a plastic material can be used or any other suitable material can be used. Also, the membrane of the bottom 32 of compartment 16 could be made from different materials than the sheets 12, 14.

Figure 3:
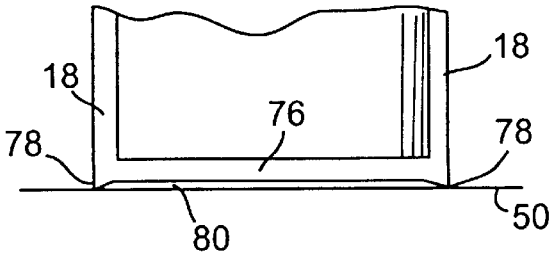
BACKGROUND ART FIG. 3
FIG. 3 is a schematic sectional view showing a lower front portion of a pouch indicating the state of the background art.

To better understand the present invention, a portion of a filled conventional stand-up pouch is shown in FIG. 3. In this arrangement, the beveled end portions 56 and 60 have not been cut away from the outer edge of the rim. This pouch of FIG. 3 is not to be equated with the pouch shown in FIGS. 1 and 2 of the present application. In particular, the pouch may not have the figure eight or hour glass shape or the pocket 28, for example. However, this conventional pouch will generally have side seams 18 similarly to the pouch of the present invention.

A rim 76 is also provided at the bottom of the pouch of FIG. 3. The compartment of this pouch is filled since this pouch is in an expanded position. In such a position, the lowermost points of the pouch will be formed at the outermost edge of the seams 18. These lowermost portions form contact points 78 with the support surface 50. The distance 80 between the outer edge of rim 76 and support surface 50 is exaggerated in FIG. 3. This distance may actually be only a few millimeters. Nonetheless, the pouch is generally supported at the two contact points 78 when resting on support 50 with the remainder of the rim being raised out of contact with support surface 50. Because there are only two main contact points 78, the pouch will wobble or teeter back and forth. In other words, the pouch will move into and out of the page as shown in FIG. 3 while pivoting about the contact points 78.

When the pouch of FIG. 3 tips sufficiently forwardly, a forward portion of the rim 76 will engage the support 50 such that three contact points will be formed. The three points will be at this contact at the forward rim and at the two contact points 78. In this position, the pouch will rest, but it will be unstable. With only a slight rearward force, the pouch will move rearwardly, pivoting about points 78. A point on the rear rim will then contact the support surface 50. The pouch of the prior art is unstably held and teeters or wobbles when resting on support 50. This unstable arrangement is undesirable and leads to the pouch easily tipping over. The contents will then spill from the pouch, wasting the product and leading to a mess.

Because the potential contact points on either the forward portion of the rim or the rearward portion of the rim are not coplanar with the contact points 78, this pouch will wobble as noted above. When the forward and rear portions of the rim 76 are discussed, it should be appreciated that the pouch shown in FIG. 3 can be made from two separate sheets or a tubular sheet. In either arrangement, a forwardmost rim 76 as seen in FIG. 3 will be provided. The rear rim is hidden from view but is positioned behind and spaced from the forward rim 76. These two rim sections basically encircle the bottom of the compartment similarly to the rim sections 36, 38 of the present invention.

Figure 4:
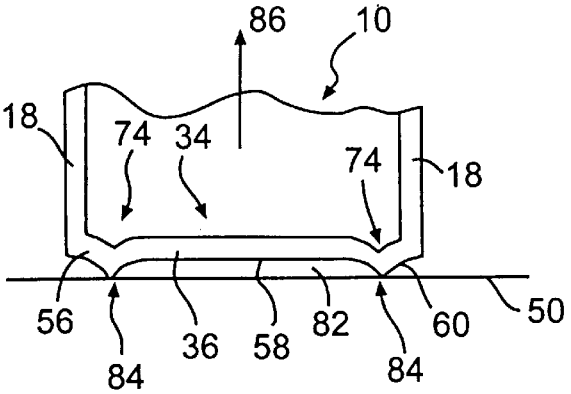
FIG. 4 is a view similar to FIG. 3 showing a portion of a lower side of the pouch of the present invention.

Turning now to FIG. 4, a schematic illustration of a filled pouch 10 of the present invention is shown. This figure shows the first sheet 12 or second sheet 14 at the front pouch. In either arrangement, the rim 34 is provided with the previously noted first beveled end portion 56, middle portion 58, and second beveled end portion 60. Also, as previously been noted, four corners 72 are generally formed around the pouch. Two such corners 72 are shown in FIG. 4 whereas the two corresponding corners would be located behind the two shown in the figures.

When the pouch 10 is in the flat position as shown in FIG. 2, the middle portion 58 of rim 34 is generally straight and flat as seen in FIG. 2. However, when the compartment 16 is filled, the pouch will bulge and form corners 72. These corners 72 can move about the periphery of the rim due to the flexible nature of the pouch. Nonetheless, four corners are generally formed as indicated and discussed with regard to FIG. 5. Two of these corners 74 are shown in FIG. 4 and they form two of coplanar feet 84 of the present invention. At each corner a coplanar foot 84 would be formed. Each of these feet 84 are in the same plane. These feet are the lowermost portion of the outer edge of rim 34. They will engage the surface 50 and provide for a stable support.

In other words, four coplanar feet 84 are provided around the periphery of the pouch 10. These feet 84 are in the same plane and will result in the filled pouch 10 being stably held in position. The middle portion 58 of rim 34 is otherwise slightly spaced from the support 50 as indicated by distance 82 in FIG. 4. This distance is exaggerated similarly to the distance 80 in FIG. 3 and can in fact only be a few millimeters. Nonetheless, the pouch 10 of the present invention generally has four coplanar feet which are the only points of contact with support surface 50.

Because the pouch 10 has been described as being made from two sheets 12, 14, it is contemplated that four coplanar feet 84 will be provided. However, if the pouch had a triangular shape, then three coplanar feet could instead be provided. It is merely necessary that at least three coplanar feet be provided in the present invention to thereby provide a stable support for the pouch 10. Because these feet are on the same plane, wobbling of the pouch on support 50 will be prevented. It should be noted in FIG. 2 that when the pouch is flat, the coplanar feet are generally flush with the outermost edge of the rim 34.

Because the portions of the rim are cut away at the beveled end portions 56, 60, the outermost edges of the seems 18 will not engage the support 50. Rather, the coplanar feet 84 will be the only positions at which the flexible pouch 10 engages the support 50. The present pouch 10 will not have outer contact points 78 as shown in FIG. 3. Therefore, as noted, the present pouch 10 will be stably held in position.

Of course, it is possible that only one side of the rim will be cut away. For example, the second beveled end portion 60 of both sections 36, 38 could be omitted such that only a first beveled end portion 56 is provided on the first rim section 36 on both the first sheet 12 and second sheet 14. In such a case, two coplanar feet 84 would be provided on the front and back of the pouch with a third coplanar foot being formed by the point at which the non-cut away seam 18 engages the support 50. This point of contact would be similar to the present invention having one of the two contact points 78 in the conventional pouch of FIG. 3. In either arrangement, coplanar feet 84 provided on the rim 34 stabilize the pouch.

Due to the provision of the coplanar feet, a longitudinal axis 86 of pouch 10 will be generally perpendicular to the support 50. If this axis 86 were inclined, the pouch could easily tip. This is especially true with a relatively tall pouch such as that shown in FIGS. 1 and 2. In other words, a tall cylindrical pouch can easily be tipped if it is not held in a straight, upright position. This problem is avoided with the present invention due to the provision of the four coplanar feet.

The present invention also provides for a method for stabilizing a flexible pouch. This method includes the steps of forming the pouch 10 with compartment 16. This compartment will have a bottom 32. A rim 34 is provided around the bottom of the compartment. This rim 34 is spaced from the bottom 32 of compartment 16 and has an outer edge spaced from the compartment. Portions 56, 60 of the rim 34 are removed to form a plurality of coplanar feet 84 on the rim. These coplanar feet 84 will stably hold the pouch when it is on a support 50.

The present invention provides for a flexible pouch and method for making the pouch which results in a stable arrangement. The pouch can assuredly rest on a support 50 without fear of tipping. The provision of the coplanar feet 84 enables the support to be stably held. It is unlikely that the pouch will wobble, teeter or tip over. Wastage of product within the pouch 10 can therefor be avoided.

As noted above, the present invention also provides for a pouch 10 having a beverage or other contents in an interior compartment 16. This beverage or other contents can be easily dispensed from pouch 10 because it is very easy to open the container and spillage of the product is minimized or eliminated. Inadvertent damage to the pouch 10 is avoided such as puncturing of both the front and rear walls when attempting to insert the straw 30. The flexible pouch can be easily manufactured and provides a secure arrangement for holding a product.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A flexible pouch comprising:

a first sheet having a first edge and a second edge;

a second sheet having a first edge and a second edge, the first edges of the first and second sheets being sealed together by a seal and the second edges of the first and second sheets being sealed together by a seal;

a compartment being formed in part by the first and second sheets between the sealed first and second edges thereof, the compartment having a bottom;

a frangible element defining a pocket and a portion of the compartment, a drink opening to the compartment being readily formable in the frangible element;

a rim formed around the bottom of the compartment, the rim being spaced from and extending outwardly from the bottom of the compartment and including a first section and a second rim section, each rim section including a middle portion and two beveled end portions; and at least three coplanar points of contact projecting from the rim for stabilizing the pouch when the pouch is resting on the points of contact, the at least three coplanar points of contact each being engageable with a support surface when the pouch is resting on the rim, each of the middle portions having at least one of the coplanar points of contact thereon, the coplanar points extending beyond the beveled end portions when the pouch is in an expanded condition such that the beveled end portions are out of contact with the support surface on which the pouch rests.

2. The flexible pouch according to claim 1, wherein an opening to the pocket extends from and between the seals at the edges of the first and second sheets.

3. The flexible pouch according to claim 1, wherein outer edges of the beveled end portions are angled relative to an adjacent middle portion at an angle between 4° and 25° when the pouch is in a flattened condition.

4. The flexible pouch according to claim 1, wherein the pouch is generally symmetrical about a medial plane intersecting the two seals and the bottom of the compartment and wherein at least one of the coplanar points of contact are provided on each side of the medial plane.

5. The flexible pouch according to claim 1, wherein the frangible element is a flexible gusset provided between the first and second sheets.

6. The flexible pouch according to claim 1, wherein the pouch has at least one side edge which forms an angle of greater than 90° with an adjacent one of the beveled end portions.

7. A flexible pouch comprising:

a first sheet having a first edge and a second edge;

a second sheet having a first edge and a second edge, the first edges of the first and second sheets being sealed together by a first side seal and the second edges of the first and second sheets being sealed together by a second side seal, the first and second side seals extending continuously across from an outermost edge, which extends coterminously with the first and second edges of the first and second sheets, to an innermost edge;

a compartment being formed in part by the first and second sheets between the sealed first and second edges thereof, the compartment having a bottom;

a frangible element defining a pocket having a mouth opening and an access area extending from and between the first and second side seals at the edges of the first and second sheets, the frangible element defining a portion of the compartment and configured to allow an opening device to form a drink opening to the compartment when the opening device is placed within the pocket, each of the seals having a thickness measured from the edges of the sheets in a direction toward the compartment, the thicknesses of each of the seals varying at least in an area adjacent to the pocket, the seals configured for moving between first and second positions in the area adjacent to the pocket, the seals being closer to one another in the second position than in the first position, the edges of the first and second sheets at the mouth opening to the pocket being separated and bowed outward from one another to expand the mouth opening and the access area so as to receive the opening device therein when the seals are in the second position; and a rim formed around the bottom of the compartment, the rim being spaced from and extending outwardly from the bottom of the compartment.

8. A flexible pouch comprising:

a front wall having first and second edges;

a rear wall having first and second edges respectively sealed to the first and second edges of the front wall by at least one seam; and a membrane defining a pocket and an access area configured to selectively seal a compartment of the pouch, the membrane including:

a first end portion sealed to an uppermost portion of the front wall by a first uppermost seam;

a second end portion sealed to an uppermost portion of the rear wall by a second uppermost seam and offset from the first end portion so as to form an outer portion exposed outside the pocket and an inner portion extending inside the pocket when the first end portion and the second end portion are moved together, the inner portion being exposed when the first end portion and the second end portion are moved apart;

a frangible portion located within the inner portion of the pocket penetrable by an opening device to form a drink opening to the pouch compartment when the opening device is placed within the pocket; and an identifying device extending from the outer portion to the inner portion of the pocket defined by the membrane and indicating to a consumer the location of the access area, wherein the identifying device comprises a color of the outer portion of the second end portion of the membrane that is different from an outer surface color of the front wall.

9. The flexible pouch of claim 8, wherein the at least one seam defines a seam area extending between an outermost side substantially coterminous with the first and second edges of the front and rear walls and an innermost side.

10. The flexible pouch of claim 8, wherein the at least one seam has an outermost edge and extends continuously across from the first and second edges of the first and second sheets to innermost edges.

11. The flexible pouch of claim 8, wherein the identifying device comprises at least one ridge pattern protruding from a surface of the membrane.

12. The flexible pouch of claim 11, wherein the at least one ridge pattern extends across a width of the outer and inner portions of the second end portion of the membrane so as to indicate where the access area is located when the first end portion and the second end portion are moved apart.

13. The flexible pouch of claim 8, wherein the membrane includes a crease extending between first and second side edges of the membrane.

14. The flexible pouch of claim 13, wherein the access area of the pocket has a width extending from and between the first and second side edges of the membrane and the identifying device is configured to extend across the width of the access area.

15. A flexible pouch comprising:

a front wall having first and second edges;

a rear wall having first and second edges respectively sealed to the first and second edges of the front wall by at least one seam; and a membrane defining a pocket and an access area configured to selectively seal a compartment of the pouch, the membrane including:

a first end portion sealed to an uppermost portion of the front wall by a first uppermost seam;

a second end portion sealed to an uppermost portion of the rear wall by a second uppermost seam and offset from the first end portion so as to form an outer portion exposed outside the pocket and an inner portion extending inside the pocket when the first end portion and the second end portion are moved together, the inner portion being exposed when the first end portion and the second end portion are moved apart;

a frangible portion located within the inner portion of the pocket penetrable by an opening device to form a drink opening to the pouch compartment when the opening device is placed within the pocket; and an identifying device extending from the outer portion to the inner portion of the pocket defined by the membrane and indicating to a consumer the location of the access area, wherein the identifying device comprises a color within the pocket that is different from an outer surface color of the front wall.

16. A flexible pouch comprising:

a front wall having first and second edges;

a rear wall having first and second edges respectively sealed to the first and second edges of the front wall by at least one seam; and a membrane defining a pocket and an access area configured to selectively seal a compartment of the pouch, the membrane including:

a first end portion sealed to an uppermost portion of the front wall by a first uppermost seam;

a second end portion sealed to an uppermost portion of the rear wall by a second uppermost seam and offset from the first end portion so as to form an outer portion exposed outside the pocket and an inner portion extending inside the pocket when the first end portion and the second end portion are moved together, the inner portion being exposed when the first end portion and the second end portion are moved apart;

a frangible portion located within the inner portion of the pocket penetrable by an opening device to form a drink opening to the pouch compartment when the opening device is placed within the pocket; and an identifying device extending from the outer portion to the inner portion of the pocket defined by the membrane and indicating to a consumer the location of the access area, wherein the identifying device comprises a material of the outer portion of the second end portion of the membrane that is different from an outer surface material of the front wall.

17. A flexible pouch comprising:

a front wall having first and second edges;

a rear wall having first and second edges respectively sealed to the first and second edges of the front wall by at least one seam; and a membrane defining a pocket and an access area configured to selectively seal a compartment of the pouch, the membrane including:

a first end portion sealed to an uppermost portion of the front wall by a first uppermost seam;

a second end portion sealed to an uppermost portion of the rear wall by a second uppermost seam and offset from the first end portion so as to form an outer portion exposed outside the pocket and an inner portion extending inside the pocket when the first end portion and the second end portion are moved together, the inner portion being exposed when the first end portion and the second end portion are moved apart;

a frangible portion located within the inner portion of the pocket penetrable by an opening device to form a drink opening to the pouch compartment when the opening device is placed within the pocket; and an identifying device extending from the outer portion to the inner portion of the pocket defined by the membrane and indicating to a consumer the location of the access area, wherein the identifying device comprises a material within the pocket that is different from an outer surface material of the front wall.

* * * * *

UNITED STATES PATENT AND TRADEMARK OFFICE

CERTIFICATE OF CORRECTION

PATENT NO.: 6,164,825

DATED: December 26, 2000

INVENTORS: Robert G. LARKIN et al.

It is certified that an error appears in the above-identified patent and that said Letters Patent is hereby corrected as shown below:

On the Title Page, [63], L. 2, change "which is" to --and--.

Signed and Sealed this

First Day of May, 2001

*Attest:*

NICHOLAS P. GODICI

*Attesting Officer*

*Acting Director of the United States Patent and Trademark Office*